United States Patent [19]

Hancock

[11] 4,126,979

[45] Nov. 28, 1978

[54] INTERLOCKING BUILDING BLOCK

[76] Inventor: Norman L. Hancock, 10439 Garibaldi St., St. Louis, Mo. 63122

[21] Appl. No.: 821,753

[22] Filed: Aug. 4, 1977

[51] Int. Cl.[2] ..... E04B 2/56; E04C 1/04

[52] U.S. Cl. ..... 52/594; 52/593

[58] Field of Search ..... 52/591, 593, 594

[56] References Cited

U.S. PATENT DOCUMENTS

| | | | |
|---|---|---|---|
| 3,427,774 | 2/1969 | Curtis | 52/415 X |
| 3,608,258 | 9/1971 | Spratt | 52/591 X |
| 3,795,079 | 3/1974 | Klem | 52/603 X |
| 3,936,989 | 2/1976 | Hancock | 52/593 |

FOREIGN PATENT DOCUMENTS

| | | | |
|---|---|---|---|
| 109,272 | 4/1928 | Australia | 52/594 |
| 672,556 | 10/1963 | Canada | 52/594 |
| 771,283 | 7/1934 | France | 52/593 |
| 516,497 | 2/1955 | Italy | 52/591 |
| 222,499 | 10/1942 | Switzerland | 52/594 |
| 760,804 | 11/1956 | United Kingdom | 52/591 |

*Primary Examiner*—Alfred C. Perham

*Attorney, Agent, or Firm*—Cohn, Powell & Hind

[57] ABSTRACT

The building block includes upper and lower sides having longitudinally extending rib and groove respectively, interfitting with the groove and rib of a compatibly formed block. The rib and groove include laterally spaced faces inclined in the same general direction and interconnected by a transverse flat face. One of the inclined faces of the rib and of the groove is provided with a stepped shoulder, the stepped shoulder of the rib face engaging the stepped shoulder of the groove face of a compatible block to preclude relative movement of the said inclined rib and groove faces having the stepped shoulders tending to separate the rib and groove.

3 Claims, 4 Drawing Figures

INTERLOCKING BUILDING BLOCK

BACKGROUND OF THE INVENTION

This invention relates generally to interlocking building blocks, and more particularly to building blocks having asymmetrical rib and groove construction.

There have been numerous attempts to improve building wall construction by utilizing molded interlocking blocks which do not require mortar joints but rely rather on the structural interengagement of block parts to stabilize the wall. Two disadvantages of existing systems are to be found in the fact that the individual blocks are either relatively complicated or else more than one type of basic block is required. Another disadvantage lies in the fact that known molded block systems are not readily adapted to produce a visual appearance which is comparable to the common brick either with respect to size or the building bond which may be achieved.

Applicant's prior U.S. Pat. No. 3,936,989 discloses an interlocking building block having asymmetrical rib and groove construction. However, while a load applied to one side of a building wall constructed of these building blocks tends to cause a tight interfitting connection between the ribs and grooves, a load on the other side of the building wall may tend to cause separation of the ribs and grooves.

SUMMARY OF THE INVENTION

The building block in a wall construction does not require mortar joints to ensure the stabilization of the wall but provides an interlocking means which resists separation of compatible blocks under load.

The speed of construction is considerably increased because of self-aligning structural arrangement of building block parts. The particular interlocking rib and groove feature provided by the blocks does not interfere with the external appearance, and the blocks are readily adaptable so that they provide a brick and mortar appearance.

The blocks are particularly susceptible to end molding techniques and are sufficiently simple in configuration to ensure that they can be inexpensively manufactured and laid without special instruction.

The present building block includes an upper side having a longitudinally extending rib with laterally spaced first and second inclined faces and a transverse face extending therebetween, the intersection between the transverse face and the first inclined face defining an acute included angle and the intersection between the transverse face and the second inclined face defining an obtuse included angle. The lower side of the building block includes a longitudinally extending groove having laterally spaced first and second inclined faces and a transverse face extending therebetween, the intersection between the transverse face and the first inclined face defining an acute included angle and the intersection between the transverse face and the second inclined face defining an obtuse included angle. The groove receives the rib of a compatible block in interfitting relation.

The said second inclined faces of the rib and groove of the building block have stepped shoulders, the stepped shoulder of the said second groove face engaging the stepped shoulder of the second rib face of a compatible block to preclude relative movement of the said second inclined faces in a direction tending to separate the rib and groove.

The stepped shoulders of the second rib and groove faces of compatible interfitting blocks are relatively offset to interfit and engage.

More particularly, the second inclined face of the rib has a first rib face portion adjacent the transverse face of the rib and a relatively inset second rib face portion, the said first rib face portion and said inset second rib face portion providing the stepped rib shoulder therebetween. Similarly, the said second inclined face of the groove has a first groove face portion adjacent the transverse face of the groove and a relatively outset second groove face portion, the said first groove face portion and said outset second groove face portion providing the stepped groove shoulder therebetween. These stepped rib and groove shoulders of compatible interfitting blocks overlap in a direction along said second inclined faces of the interfitting rib and groove to engage and preclude relative sliding movement of said second inclined rib and groove faces which would otherwise tend to separate the rib and groove.

The said first rib and groove face portions and the said second rib and groove face portions of compatible interfitting blocks are relatively laterally spaced for enabling the rib and groove of compatible blocks to interfit and yet allow the stepped shoulders to overlap in a direction along the said second inclined faces of the rib and groove.

DESCRIPTION OF THE PREFERRED EMBODIMENT

Figure 1:
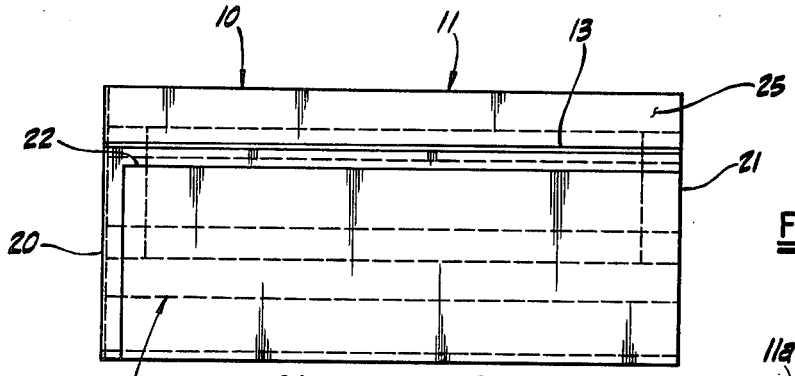
FIG. 1 is a side elevational view of the building block.

It will be understood that the building block 10 can be utilized in a building wall as is disclosed in U.S. Pat. No. 3,936,989, which is incorporated by reference.

Referring now by characters of reference to the drawing, each block 10 includes a rib 11 and a groove 12, both extending longitudinally substantially the entire length of the block 10. The rib 11 and the groove 12 are formed so that the rib 11 can be received within the groove **12*a* of a compatibly formed block 10*a*. The rib 21 and contiguous, downwardly sloped flanking portions 13 and 14 form the upper side of the block 10. The groove 12 and contiguous, downwardly sloped flanking portions 15 and 16 form the lower side of the block 10. It will be understood that the downward slope of the flanking portions 15–16** precludes the retention of rain water on these surfaces.

The block 10 further includes front and rear sides 17 and 18, and opposed ends 20 and 21. Each of the sides 17 and 18 includes right angularly related, recessed margin portions 22 and 23 respectively, which provide mortar-simulating strips and define a substantially rectangular brick-simulating facing panel about the size of a common brick.

Importantly, the rib 11 and groove 12 are configurated to interlock in such a manner that the bending resistance is offered to forces applied to the front of the wall, i.e., on the front side 17 of the block 10. However, as will be described later, provisions are made to take care of those forces applied on the rear side of the wall.

The rib 11 includes a transverse face 24 which extends between laterally spaced first face 25 and second face 26 inclined in the same general directions at angles A and B respectively measured clockwise from a horizontal line 27. This geometrical arrangement provides that the intersection between transverse face 24 and said first rib face 25 defines an acute included angle, and further provides that the intersection between said transverse face 24 and said second rib face 26 defines an obtuse included angle.

Similarly, the groove 12 includes a transverse face 30 extending between laterally spaced first groove face 31 and second groove face 32. The groove faces 31 and 32 are inclined in the same general directions at angles A and B so that the intersection between said transverse face 30 and said first groove face 31 defines an acute included angle and the intersection between the transverse face 30 and the said second groove face 32 defines an obtuse included angle.

In the preferred embodiment, angles A of the rib 11 and groove 12 are identical, and angles B of the rib 11 and the groove 12 are identical. However, angles A and B are not equal, angle A being greater than angle B so that the spaced rib faces 25 and 26 converge outwardly, and the spaced groove faces 31 and 32 converge inwardly. Both angles A and B are less than right angles, but because angle A is greater than angle B, the sum of the acute and obtuse included angles is greater than two right angles. Angles of 76° (A) and 70° (B) have been used.

The mouth of the groove 12, which is defined by the distance L, is greater than the maximum width of the rib 11, which is defined by the distance L'. This geometrical arrangement facilitates entry of the rib 11 within the groove 12. In the preferred form of manufacture, an end mold is used. As described in U.S. Pat. No. 3,936,989, the above described relationship between angles A and B ensures that the wear on the mold which tends to be excessive at obtuse angles is compensatory in nature and results in a prolonged mold life, particularly when the block 10 is removed from the molds by end movement. A length L' 1/16 inch less than L has been used.

The block 10 can readily be made hollow, where a lighter weight block is desired, by the provision of a longitudinal passage 33. Longitudinal, semi-circular grooves 34 can also be provided to accommodate longitudinally disposed reinforcing rods (not shown).

Figure 2:
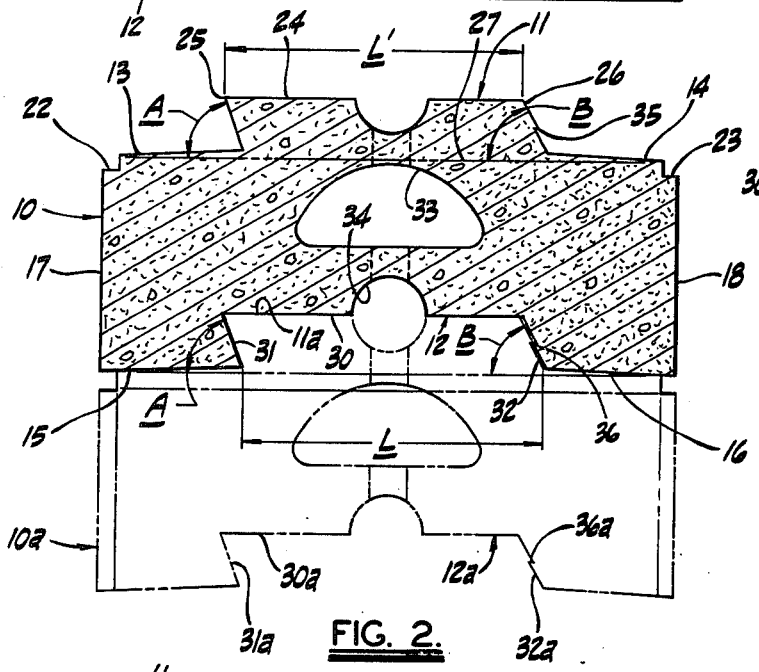
FIG. 2 is a cross sectional view of the building block shown in FIG. 1 interfitted with a compatible block.

FIG. 2 illustrates the block 10 interconnected to an identical compatible block **10*a* shown in phantom lines for clarity. To assemble superjacent blocks, the block 10 is held over the subjacent compatible block 10*a*, and the said first groove face 31 of block 10 is placed next to the coacting said first rib face 25*a* of the compatible block 10*a* as the rib 11*a* of the compatible block is inserted into the groove 30. Then, the block 10 is swung downwardly to insert the rib 11*a* of the compatible block 10*a* fully into the groove 30 of block 10, thereby placing the said second groove face 32 next to the said second rib face 26*a* of the compatible block 10*a*. There is sufficient space between the second groove face 32 and second rib face 26*a* to allow this insertion without obstruction as the block 10 is swung downwardly. When the blocks are assembled as shown in FIG. 2, and a load is applied to the front side 11 of the block 10, the said first groove face 31 and the coacting said first rib face 25*a* of the compatible block 10*a* interengage. The angular disposition of these interengaging first rib and groove faces 25*a* and 31 precludes any relative upward movement of the said first groove face 31 and the said first rib face 25*a* of the compatible block 10*a* which would otherwise tend to remove the rib 11*a* of the compatible block 10*a* from the groove 12**.

Figure 4:
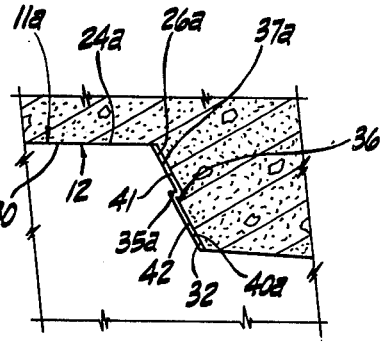
FIG. 4 is an enlarged, fragmentary view of the interlocking stepped shoulders between interfitting rib and groove of compatible blocks.
Figure 3:
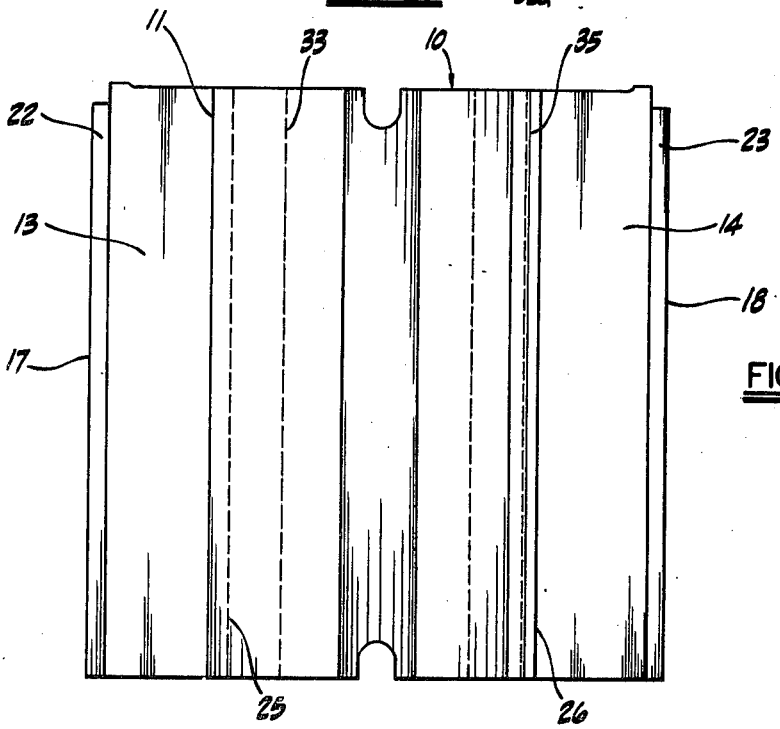
FIG. 3 is a top plan view of the building block shown in FIGS. 1 and 2.

Importantly, the rib 11 and groove 12 are also configurated to interlock in such a manner that bending resistance is offered to forces applied to the rear side 18 of interconnected blocks 10 and **10*a*. The said second inclined faces 26 and 32 of the rib 11 and groove 12 are provided with stepped shoulders 35 and 36 respectively. As is best shown in FIG. 4, the stepped shoulder 36 of said second groove face 32 engages the stepped shoulder 35*a* of the said second rib face 26*a* of a compatible block 10*a* when such lateral forces are applied to the rear side 18 of interconnected blocks 10 and 10*a* to preclude relative movement of said second inclined rib and groove faces 26*a* and 32 which would otherwise tend to separate the rib 11*a* and groove 12**.

More particularly, the second inclined face 26 of the rib 11 has a first rib face portion 37 adjacent the transverse face 24 of rib 11, and has a relatively inset second rib face portion 40. The said first rib face portion 37 and said inset second rib face portion 40 provide the stepped rib shoulder 35 therebetween.

The said second inclined face 32 of the groove 12 has a first groove face portion 41 adjacent the transverse face 30 of the groove 12, and has a relatively outset second groove face portion 42. The said first groove face portion 41 and said outset second groove face portion 42 provide the stepped groove shoulder 36 therebetween.

The said first rib and groove face portions **37*a* and 41, and the said second rib and groove face portions 40*a* and 42 of compatible interfitting blocks 10 and 10*a* are relatively laterally spaced to enable the rib 11*a* and groove 12 of compatible blocks 10 and 10*a* to interfit, and yet allow the stepped shoulders 35*a* and 36 to overlap in a direction along the said second rib and groove faces 26*a* and 32**.

When a force is applied to the rear side 18 of the building block 10, the said second rib and groove faces **26*a* and 32 will engage, and the stepped shoulders 35*a* and 36 will overlap in a direction along such faces 26*a* and 32. Moreover, the stepped shoulders 35*a* and 36 will engage to preclude relative movement in a direction along the said second rib and groove faces 26*a* and 32 which would otherwise tend to withdraw the rib 11*a* from the groove 12**.

I claim as my invention:

1. building block comprising:

(a) an upper side including a longitudinally extending rib having laterally spaced first and second inclined faces and a transverse face extending therebetween, the intersection between said transverse face and said first inclined face defining an acute included angle, and the intersection between said transverse face and said second inclined face defining an obtuse included angle, (b) a lower side including a longitudinally extending groove having laterally spaced first and second inclined faces and a transverse face extending therebetween, the intersection between said transverse face and said first inclined face defining an acute included angle, and the intersection between said transverse face and said second inclined face defining an obtuse included angle, said groove receiving the rib of a compatible block in interfitting relation as the first inclined faces of the rib and groove are placed together and the uppermost block is swung downwardly on the compatible block, (c) said second inclined faces of the rib and groove having stepped shoulders, the stepped shoulder of the said second groove face engaging the stepped shoulder of the said second rib face of a compatible block to preclude relative movement of the said second inclined faces tending to separate the interfitted rib and groove when lateral forces are applied to the side of the interconnected blocks on which the stepped shoulders are located, and (d) opposed front and rear sides and opposed ends.

2. A building block as defined in claim 1, in which:

(e) the said second inclined face of the rib has a first rib face portion adjacent the transverse face of the rib and a relatively inset second rib face portion, the said first rib face portion and said inset second rib face portion providing the stepped rib shoulder therebetween, (f) the said second inclined face of the groove has a first groove face portion adjacent the transverse face of the groove and a relatively outset second groove face portion, the said first groove face portion and the said outset second groove face portion providing the stepped groove shoulder therebetween, and (g) the second inclined faces of compatible interfitting blocks are laterally spaced for insertion of the rib in the groove as the uppermost block is swung downwardly.

3. A building block as defined in claim 2, in which:

(h) the said first rib and groove face portions of compatible interfitting blocks are relatively laterally spaced, and the said second rib and groove face portions of compatible interfitting blocks are relatively laterally spaced for enabling the rib and groove of compatible blocks to interfit as the uppermost block is swung downwardly, and yet allowing the stepped shoulders to overlap when the lateral forces are applied.

* * * * *